US005253894A

United States Patent [19]

Thomas et al.

[11] Patent Number: 5,253,894

[45] Date of Patent: Oct. 19, 1993

[54] INTERFACE PLATE FOR SKI SAFETY BINDING

[75] Inventors: Pascal Thomas, Chambery; Renaud G. Gilles, Cran-Gevrier; Daniel Saxod, Cruseilles, all of France

[73] Assignee: Salomon S.A., Chavanod, France

[21] Appl. No.: 958,719

[22] Filed: Oct. 9, 1992

[30] Foreign Application Priority Data

Oct. 10, 1991 [FR] France ..... 91 12710

[51] Int. Cl.[5] ..... A63C 9/00

[52] U.S. Cl. ..... 280/607; 280/633; 280/636

[58] Field of Search ..... 280/607, 633, 634, 636, 280/617

[56] References Cited

U.S. PATENT DOCUMENTS 4,438,948 3/1984 Gertsch ..... 280/607
5,042,829 8/1991 Sedlmair ..... 280/636

FOREIGN PATENT DOCUMENTS 214326 8/1960 Austria ..... 280/607
0319714 6/1989 European Pat. Off. .
0353567 6/1990 European Pat. Off. .

*Primary Examiner*—Richard M. Camby
*Attorney, Agent, or Firm*—Pollock, Vande Sande & Priddy

[57] ABSTRACT

Interface plate for alpine ski safety binding. The plate has an edge (3) extending along at least one portion of the lateral edges of the base. On either side of its median zone, the plate has a lateral element (5) which carries the edge (3). The lateral elements (5) are inclined substantially downward and outward from the plate, so that, when the binding base is assembled on the ski and the plate is clamped between the base and the ski binding, the lateral elements (5) straighten into a horizontal position, thus forcing the edges (3) to flatten along the lateral edges of the base.

8 Claims, 3 Drawing Sheets

INTERFACE PLATE FOR SKI SAFETY BINDING

FIELD OF THE INVENTION

The invention relates to an interface plate for an alpine ski safety binding.

BACKGROUND OF THE INVENTION

Numerous types of alpine ski safety bindings are known, and, in particular, front binding elements, which comprise a base by means of which the binding is assembled to the ski. Many of these bindings are made of a plastic material or, at the least, have a base made of a plastic material.

It thus happens that, when the binding is assembled to the ski, a space is created between the upper surface of the ski and the binding base. Snow or dirt can penetrate into this space and impair the operation of the binding.

Some interface plates exist whose main function is to hold the assembly screws in place in their orifices in the base until they are tightened in the ski. These plates perform, however, no impermeability function between the base and the upper surface of the ski.

SUMMARY OF THE INVENTION

One of the objects of the present invention is to propose an interface plate which provides effective impermeability between the base of the binding and the ski.

Another purpose of the present invention is to object an interface plate which can be easily assembled to the binding at the factory.

A further purpose of the invention is to object an interface plate which holds the assembly screws belonging to the binding in their orifices in the base until the binding is assembled to the ski.

Other objects and advantages of the invention will emerge during the following description.

The interface plate according to the invention has an edge extending along at least one portion of the lateral edges of the binding base, and incorporates, on either side of its median zone, a lateral element inclined substantially downward and outward, in such a way that, when the base is assembled to the ski and the plate is squeezed between the base and the ski binding, the lateral elements straighten into a horizontal position, thereby forcing the edges to flatten along the lateral edges of the base.

BRIEF DESCRIPTION OF THE DRAWINGS

The invention will be better understood with reference to the following description and to the attached drawings.

DESCRIPTION OF THE PREFERRED EMBODIMENT

Figure 1:
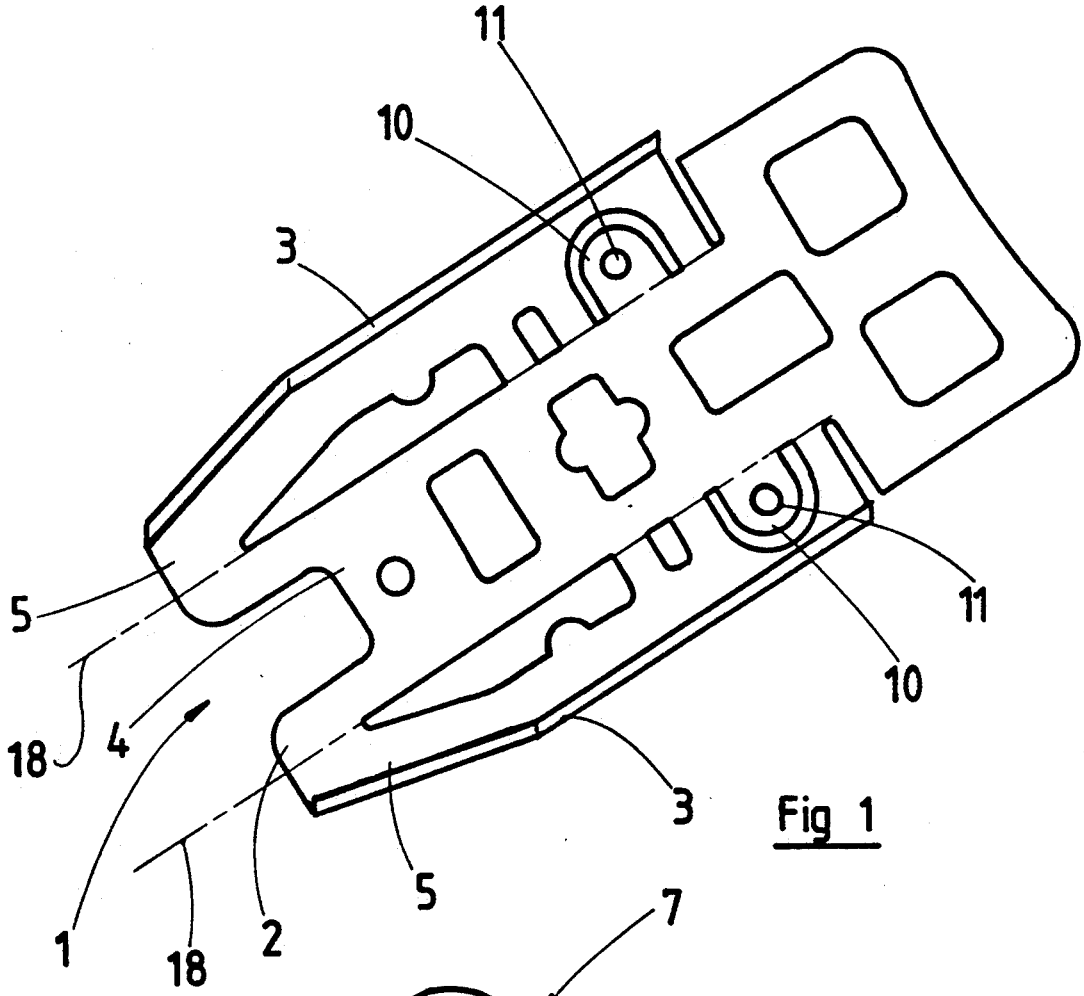
FIG. 1 is a perspective view of an interface plate according to a first embodiment of the invention.
Figure 2:
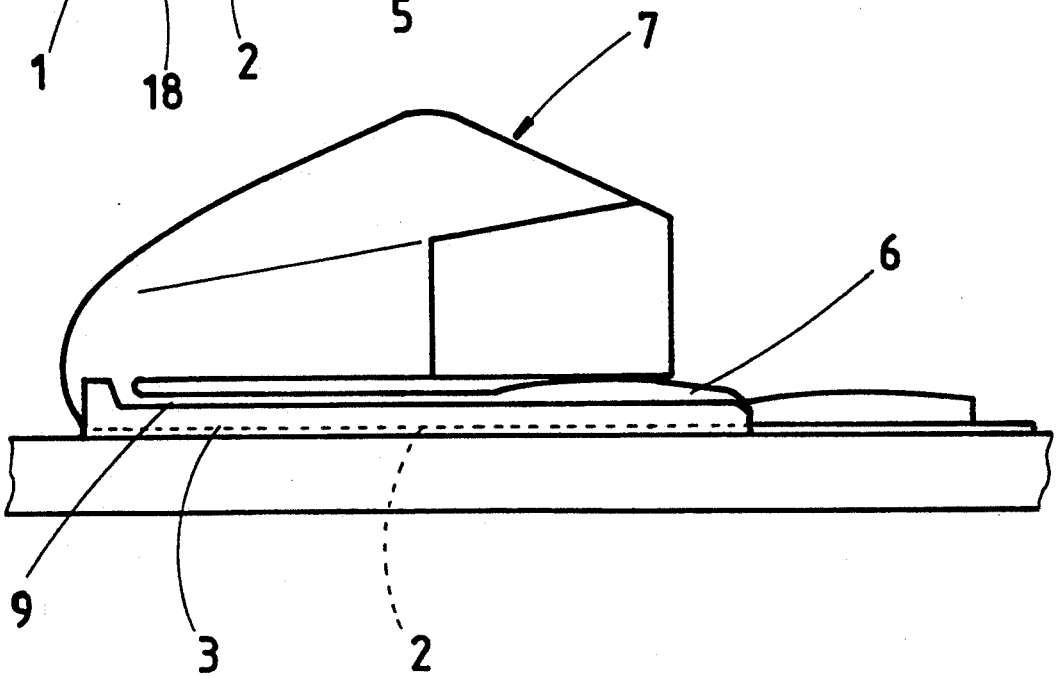
FIG. 2 is a side view of a front binding equipped with the plate in FIG. 1.

FIG. 1 shows an interface plate 1 designed to equip a front binding 7. The plate 1 has a bottom 2 whose surface and outer contour substantially correspond to those of the base and of the plate supporting the binding 7. In the embodiment shown, the bottom further incorporates various recesses, whose existence and nature are not restrictive.

The plate is preferably made of an elastically-deformable plastic material, e.g., a polypropylene or fiber-loaded polyamide. However, any elastically-deformable material would also be suitable.

The plate 1 has, over a portion of its periphery, an edge 3 which is designed to rise along the lateral faces 9 of the base 6 of the binding 7.

The bottom of the plate has a median zone, here formed by a median part 4 extending longitudinally and by two lateral elements 5 extending on either side of the median part 4. The edges 3 are attached to the lateral elements 5.

The boundaries separating the median part 4 and the two lateral elements 5 have been schematically represented by dotted lines 18 in FIG. 1. These boundaries are, in this case, parallel and run longitudinally.

According to the invention, the lateral elements 5 of the plate are inclined downward and outward. The inner face of the edges 3 then opens slightly outward.

The angle of inclination between the upper surface of the lateral element 5 and the horizontal is preferably greater than the angle of inclination between the inner surface of the edge 3 and the vertical. Accordingly, when the binding is assembled to the ski, the bottom 2 of the plate is squeezed between the base 6 of the binding and the upper surface of the ski. This squeezing action forces the lateral elements 5 to straighten into a horizontal position in alignment with the median part 4, and the edges 3 are then stressed so as to be pressed against the lateral faces 9 of the base 6. Given the difference between the angles mentioned above, the edges 3 exert an elastic support force on the lateral faces 9 of the base 6, thereby providing effective impermeability in this area. In fact, the edges 3 block up the space potentially created between the base and the upper surface of the ski.

Good results have been obtained using an angle of approximately 10° between the lateral elements 5 and the horizontal, and an angle of approximately 3° between the edges 3 and the vertical, i.e., an angular difference of 7°, which determines the force with which the edges 3 are pressed against the lateral faces of the base 6. This arrangement is, of course, not restrictive, and other angular values are suitable.

According to a preferred embodiment, the plate 1 has, in the area of the screws used to mount the base on the ski, disks 10 which extend the median part 4 laterally. These disks have an orifice 11 whose diameter is substantially less than the diameter of the threaded portion of a screw. Accordingly, these disks and their orifices can firmly hold in place a binding-assembly screw, whose threaded portion engages in the orifice.

Thus, it is possible, during manufacture, to hold the plate beneath the base using screws, and, moreover, to retain the assembly screws in their orifices by means of the plate.

Figure 3:
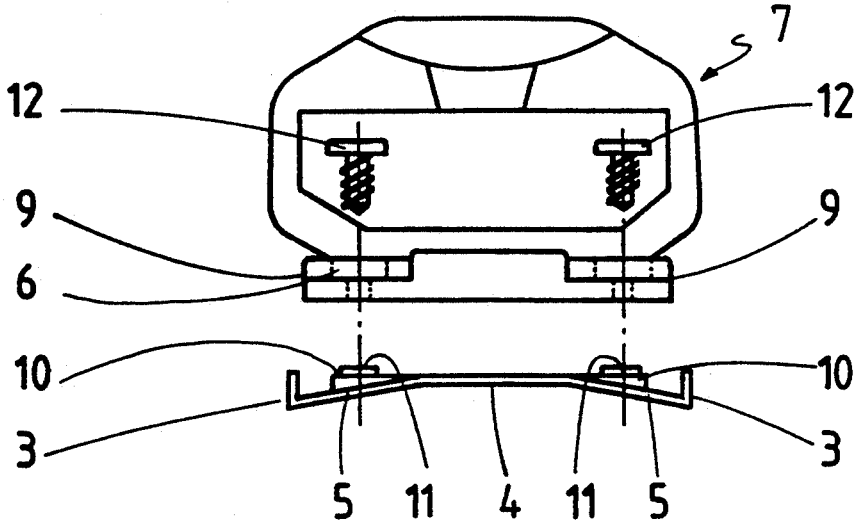
FIGS. 3, 4, and 5 illustrate a mode of use of the plate during manufacture and assembly of the binding on the ski.
Figure 4:
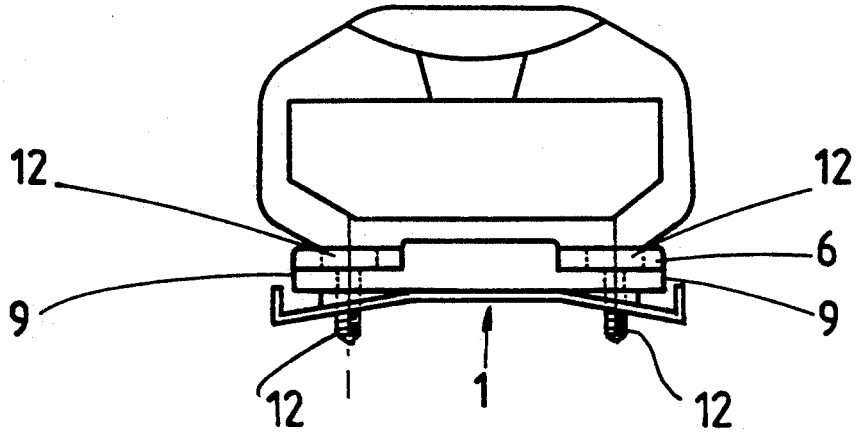

FIGS. 3 and 4 illustrate this function of the plate. As has been stated above, the lower faces of the edges 3 open substantially outward. In this way, the base 6 of the binding can be positioned above the plate and be easily positioned inside the edges. The screws 12 are then inserted in their orifices, and their threaded portions engaged in the orifices 11 in the plate. Accordingly, and as illustrated in FIG. 4, the screws 12, the plate 1, and the base 6 form a one-piece assembly. This operation may advantageously be performed automatically.

Figure 5:
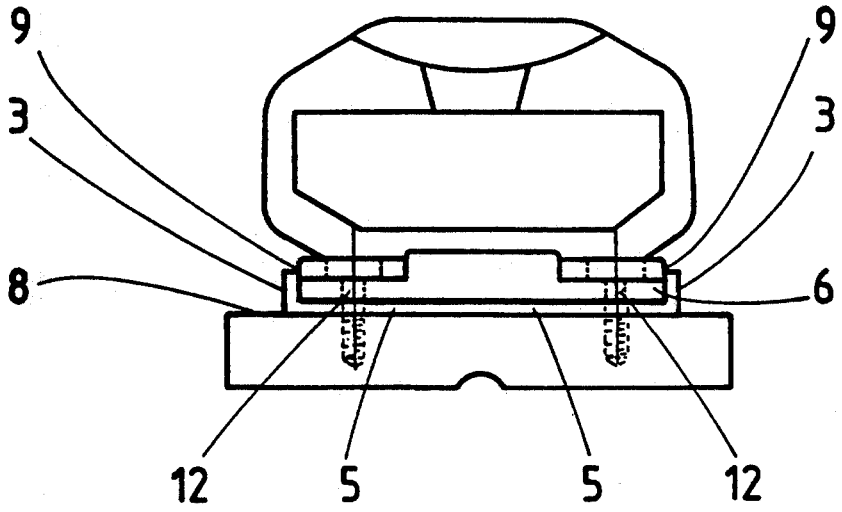

The binding is prepared in this way until it is mounted on the ski. FIG. 5 illustrates this assembly, and, as stated previously, tightening the screws 12 squeezes the plate 1 between the base 6 and the ski, thereby straightening the lateral elements 5 into a horizontal position and flattening the edges 3 against the lateral faces of the base.

Figure 6:
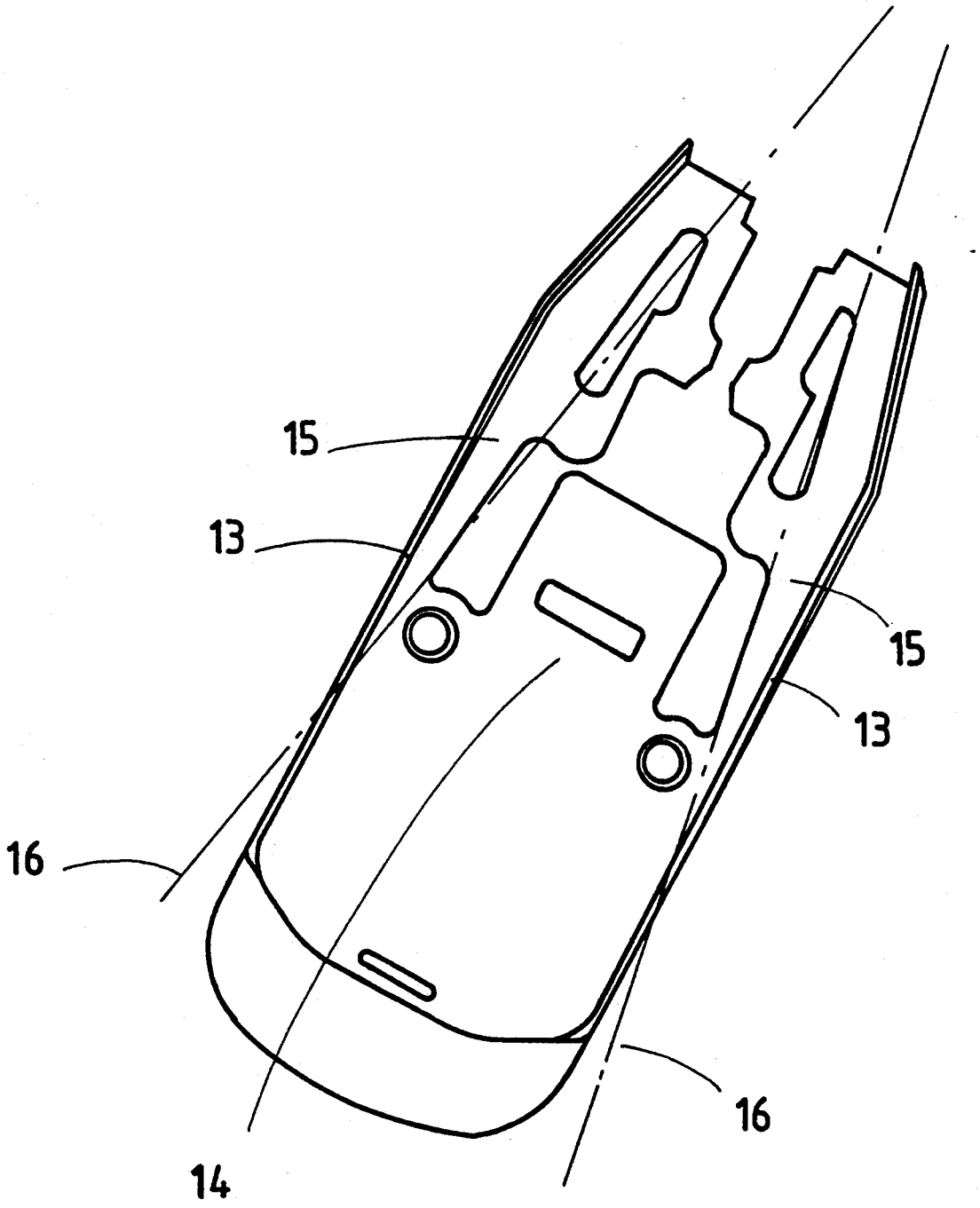
FIG. 6 is a perspective view of a variant of the interface plate according to the invention.

FIG. 6 represents a variant, in which the boundaries between the central part 14 and the lateral elements 15 (represented schematically by dot-and-dash lines 17), are oblique and converge toward the front of the binding. Thus, the boundaries 15 intersect with the edges 13 at the rear of the binding, thereby making it possible to produce this edge in continuous fashion from the front to the rear of the binding, even though only one portion is connected to the lateral elements 15 of the plate.

The present description is not restrictive, and other variants are possible. In particular, depending on the areas in which one wishes to flatten the edge against the base, the lateral elements of the plate could be produced differently, e.g., segmentally.

What is claimed is:

1. Interface plate for an alpine ski safety binding comprising a base designed to be assembled to the upper surface of a ski, wherein said plate has an edge (3, 13) extending along at least one portion of its periphery and rising along lateral faces of the binding base and wherein said plate has, on either side of its median zone, a lateral element (5, 15) carrying said edge (3, 13) and which is inclined substantially downward and outward from said plate, so that, when said base (6) is mounted on the ski and said plate (1) is squeezed between said base of the binding and said ski, said lateral elements (5, 15) straighten into a horizontal position, thereby forcing said edges (3, 13) to flatten along said lateral faces of said base.

2. Plate according to claim 1, wherein the inner face of an edge (3) forms, in conjunction with the corresponding lateral face of the base (6), an angle less than that between the upper surface of the lateral element (5) of said plate and the horizontal.

3. Plate according to claim 2, wherein the inner faces of said edges (3) open upward and outward.

4. Plate according to claim 2, wherein the inner face of an edge (3) forms, with the vertical, an angle of approximately 3° and the upper surface of said lateral element (5) is inclined downward and outward by an angle of approximately 10°.

5. Plate according to claim 1, wherein said plate has, between said lateral elements (5, 15), a substantially horizontal median part (4, 14).

6. Plate according to claim 5, wherein the boundaries (18) between said median part (4) and said lateral elements (5) are parallel and extend longitudinally.

7. Plate according to claim 5, wherein the boundaries (17) between said median part (14) and said lateral elements (15) converge toward the front.

8. Plate according to claim 5 for an alpine ski binding, which is assembled to the ski by at least one screw (12) passing through an orifice in said base, wherein said median part has, locally, two lateral disks (10) provided with orifices (11) facing the orifice in said base, in order to hold firmly in place the lower end of said assembly screw and thus, to hold said plate (1) assembled to said base (6) until said binding is mounted on the ski, and, moreover, to hold said screw in position ready to be screwed into said ski.

* * * * *

UNITED STATES PATENT AND TRADEMARK OFFICE

CERTIFICATE OF CORRECTION

PATENT NO. : 5,253,894
DATED : October 19, 1993
INVENTOR(S) : Pascal Thomas, et. al.

It is certified that error appears in the above-indentified patent and that said Letters Patent is hereby corrected as shown below:

Title page, item [75], inventor: the second inventor's name should be -- Gilles Renoud Goud --.

Signed and Sealed this

Seventeenth Day of May, 1994

*Attest:*

*Attesting Officer*

BRUCE LEHMAN

*Commissioner of Patents and Trademarks*